US006050435A

United States Patent [19]

Bush et al.

[11] Patent Number: 6,050,435

[45] Date of Patent: Apr. 18, 2000

[54] CLOSURE WITH INTEGRAL SELF-SEALING SILICONE VALVE AND METHOD FOR MAKING SAME

[75] Inventors: Randall G. Bush; Kent A. Johnson, both of Evansville, Ind.

[73] Assignee: Rexam Plastics, Inc., Evansville, Ind.

[21] Appl. No.: 08/827,299

[22] Filed: Mar. 28, 1997

[51] Int. Cl.[7] ..... B65D 39/00

[52] U.S. Cl. ..... 215/250; 215/249; 215/260; 215/311; 222/490; 222/494; 222/541.9

[58] Field of Search ..... 215/247, 249, 215/250, 251, 270, 310, 311, 260; 222/490, 494, 541.9

[56] References Cited

U.S. PATENT DOCUMENTS

| | | | |
|---|---|---|---|
| 2,395,149 | 2/1946 | Shaw | 215/249 |
| 2,772,817 | 12/1956 | Jauch . | |
| 2,785,841 | 3/1957 | Westgate . | |
| 3,089,604 | 5/1963 | Golde et al. . | |
| 3,379,326 | 4/1968 | Andersen | 215/249 |
| 4,057,177 | 11/1977 | Laauwe . | |
| 4,102,476 | 7/1978 | Loeffler . | |
| 4,201,491 | 5/1980 | Kohler . | |
| 4,468,367 | 8/1984 | Beune et al. . | |
| 4,497,765 | 2/1985 | Wilde et al. . | |
| 4,513,891 | 4/1985 | Hain et al. . | |
| 4,660,747 | 4/1987 | Borg et al. | 222/490 X |
| 4,746,017 | 5/1988 | Howard et al. | 215/249 X |
| 4,747,518 | 5/1988 | Laauwe . | |
| 4,749,108 | 6/1988 | Dornsbusch et al. . | |
| 4,784,817 | 11/1988 | Towns et al. . | |
| 4,803,031 | 2/1989 | Ochs et al. . | |
| 4,863,049 | 9/1989 | Suzuki et al. | 215/249 |
| 4,957,211 | 9/1990 | Ekkert et al. . | |
| 4,991,745 | 2/1991 | Brown . | |
| 5,005,737 | 4/1991 | Rohr . | |
| 5,071,017 | 12/1991 | Stull . | |
| 5,085,332 | 2/1992 | Gettig et al. | 215/249 |
| 5,096,643 | 3/1992 | Kowanz et al. . | |
| 5,114,030 | 5/1992 | Conard | 215/249 |
| 5,316,163 | 5/1994 | Von Schuckmann | 215/249 |
| 5,324,470 | 6/1994 | Comert et al. . | |
| 5,433,330 | 7/1995 | Yatsko et al. | 215/247 |

*Primary Examiner*—Stephen K. Cronin
*Attorney, Agent, or Firm*—Middleton & Reutlinger; John F. Salazar; Charles G. Lamb

[57] ABSTRACT

A self-sealing, tamper-evident closure including a cap body and an integrally-formed gasket valve is provided for use on a container. The cap body includes a tab integrally molded onto a removable frangible portion which breaks away from the cap body and exposes a self-sealing, flexible gasket valve. The gasket valve is molded in place on an inner surface of the cap body and includes a longitudinal slit to provide a dispensing orifice. A method for making a closure of the present invention is also disclosed, wherein an integral cap body is formed by injection molding, a quantity of liquid gasket material is deposited within a pocket formed on the cap body, a flexible gasket valve is formed by the liquid gasket valve material curing in place within the pocket and a longitudinal slit is imposed through the gasket valve to provide a dispensing orifice.

11 Claims, 9 Drawing Sheets

CLOSURE WITH INTEGRAL SELF-SEALING SILICONE VALVE AND METHOD FOR MAKING SAME

BACKGROUND OF THE INVENTION

1. Technical Field of the Invention

The present invention relates to self-sealing, tamper-evident closures for use on containers, and methods for making same. More particularly, the present invention relates to tamper-evident closures having an integrally-formed self-sealing valve cured in place.

2. Discussion of the Prior Art

Closures having a self-sealing dispensing orifice are relatively well-known in the prior art. Typically, such closures include a flexible gasket valve and a separate cap body. Generally, the complete closure assembly is formed through a multiple-step process comprising the steps of forming a flexible gasket from a rubber material such as silicone; punching a longitudinal slit through the flexible gasket to allow a liquid to pass therethrough; forming a hard, plastic cap body to support and hold the flexible gasket in place; and, and placing the flexible gasket in the cap body. The complete closure assembly is then threadingly attached to the open neck of a container, which cooperates with the threads of the cap body to retain the flexible gasket and hold it firmly in place.

Dispensing of a liquid contained within the container is achieved by increasing the pressure therein, such as by squeezing the sides of the container. The build-up of pressure behind the flexible gasket forces the longitudinal slit to open, permitting liquid to pass therethrough. Upon releasing the applied pressure, the slit returns to its original "closed" position, thereby sealing the container against further dispensing.

U.S. Pat. No. 4,991,745 to Brown is typical of prior art self-sealing closures comprising a separate gasket valve and cap. However, a gasket valve which is separate and removable from the cap body may disassociate itself from the cap body, falling within the container or otherwise becoming lost, thereby rendering the closure ineffective to both seal the container and provide a recloseable dispensing means. Further, additional manufacturing steps are required to separately form the several component parts and then assemble all parts together requires expensive equipment and production time.

Attempts have been made to provide a closure with an integral, self-sealing gasket. U.S. Pat. No. 4,201,491 to Kohler is an example of a one-piece, single-composition rubber closure having a dispensing slit. However, such one-piece rubber closures do not possess the rigidity necessary to provide a closure which is difficult to remove from the neck of a container. And, it is desirable for a closure to possess both the rigidity of construction to prohibit the removal thereof from the neck of a container, while furthermore possessing a flexible member to provide a self-sealing dispensing orifice.

SUMMARY OF THE INVENTION

The present invention relates generally to self-sealing, tamper-evident closures for use on containers, and methods for making same.

A closure of the present invention includes a hard-plastic cap body and an integrally-formed self-sealing valve cured in place on an inner surface of the cap body. The rigid cap body provides secure means for affixing the closure to the neck of a container; the valve provides a self-sealing dispensing orifice through which the liquid contents of a container may be dispensed, while providing resilient sealing means when dispensing is not desired.

A tab is securely attached to a frangible region of the cap body adjacent to the self-sealing valve. The closure is opened a first time by applying sufficient removal force to the tab to cause the frangible region to break away from the cap body, thereby exposing the self-sealing valve. The contents of the container can thereafter be dispensed by squeezing the outer wall of the container to induce sufficient pressure therein to open the slit of the self-sealing valve and to permit the liquid to pass therethrough. Once the squeezing force is no longer applied, the resilient self-sealing valve returns to its original "closed" position, thereby preventing further liquid from being dispensed therethrough. Upon opening the closure a first time, evidence of container tampering is provided by the absence—or breaking—of the frangible portion of the cap body.

A closure of the present invention includes a cap body having a top wall and a downwardly-depending annular skirt integrally formed with said top wall at an outer perimeter thereof. A continuous bead is provided on an inner annular skirt surface to attach the closure to a cooperating continuous bead on the exterior surface of a container neck.

A frangible portion of the cap body having an upper surface and a lower surface is provided on the top wall thereof. A tab extends upwardly from the upper surface of the frangible portion and provides a means for removing the frangible portion from the cap body. A retaining wall projects downwardly and inwardly from the lower surface of the frangible portion and, together with the lower surface of the top wall, provides a pocket to receive and form a quantity of liquid gasket valve material deposited therein. Liquid gasket valve material, being cured and having a slit imposed therein, forms a self-sealing gasket valve.

Further, a closure of the present invention may include a sealing liner on a lower surface of the top wall surrounding the frangible portion. However, in the preferred embodiment, the top wall of the cap body includes an upper radial ring having an inner diameter and an outer diameter, wherein the outer diameter of the upper radial ring is coincident with the outer perimeter of the top wall; a downwardly-depending annular shoulder wall having an upper end coincident with the inner diameter of the upper radial ring, a lower end, an inner annular surface and an outer annular surface; and, a lower shelf having an outer diameter coincident with the lower end of the annular shoulder wall, wherein the frangible portion of the cap body is coplanar and concentric with the lower shelf. The closure provides a plug-type liquid-impervious seal by the cooperation of the outer annular surface of the downwardly-depending annular shoulder wall with the container neck.

Even further, a closure of the present invention may include a cap body having a top wall and a downwardly-depending annular skirt integrally formed with the top wall at an outer perimeter thereof; a frangible portion formed integrally with the top wall; a gasket valve integrally and concentrically formed on a lower surface of the top wall; and, a removable sealing member integrally formed on an upper surface of the frangible region.

Finally, the present invention further includes a method by which a closure of the present invention is made. Such method includes the steps of providing a mold conforming to the size, shape and geometry of a cap body; injecting a fixed quantity of a liquid polymer material into the mold;

permitting the injected polymer to cure into the molded shape of the cap body; depositing a small quantity of a liquid gasket valve material into a pocket provided on the cap body; permitting the gasket valve to cure in place in the pocket; and, slitting the cured gasket valve to form a longitudinal dispensing slit therethrough.

BRIEF DESCRIPTION OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENT

Figure 1:
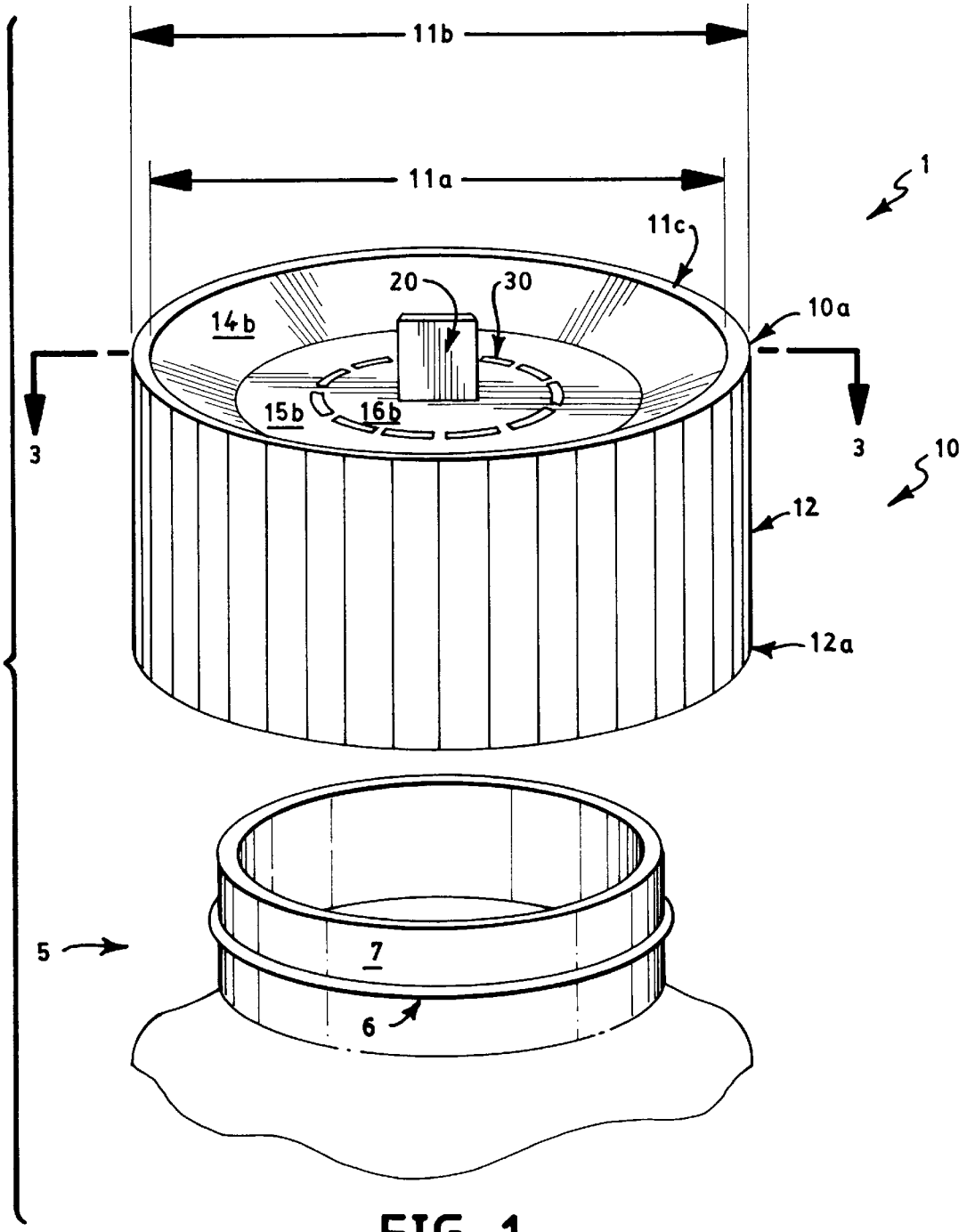
FIG. 1 is a top perspective view of a preferred closure of the present invention and a neck portion of a container, as such cap appears before the frangible portion is removed therefrom.
Figure 2:
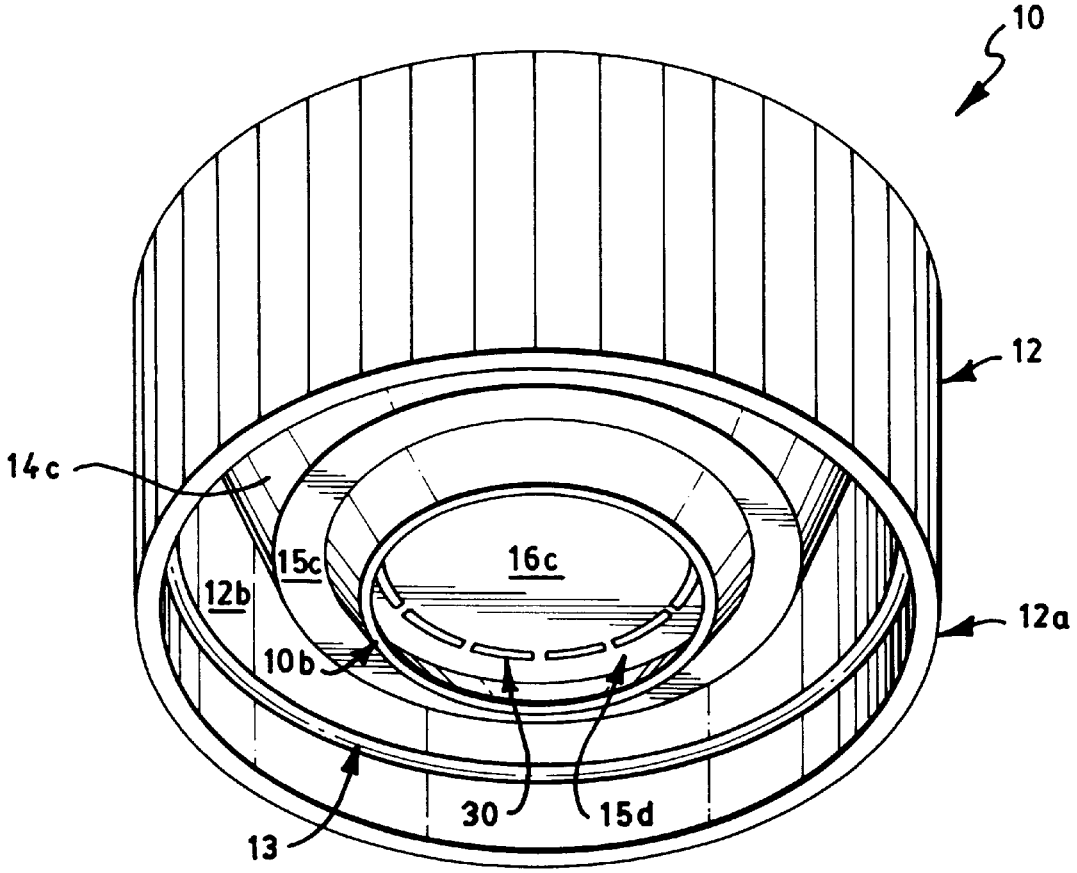
FIG. 2 is a bottom perspective view of the preferred closure of FIG. 1.
Figure 3:
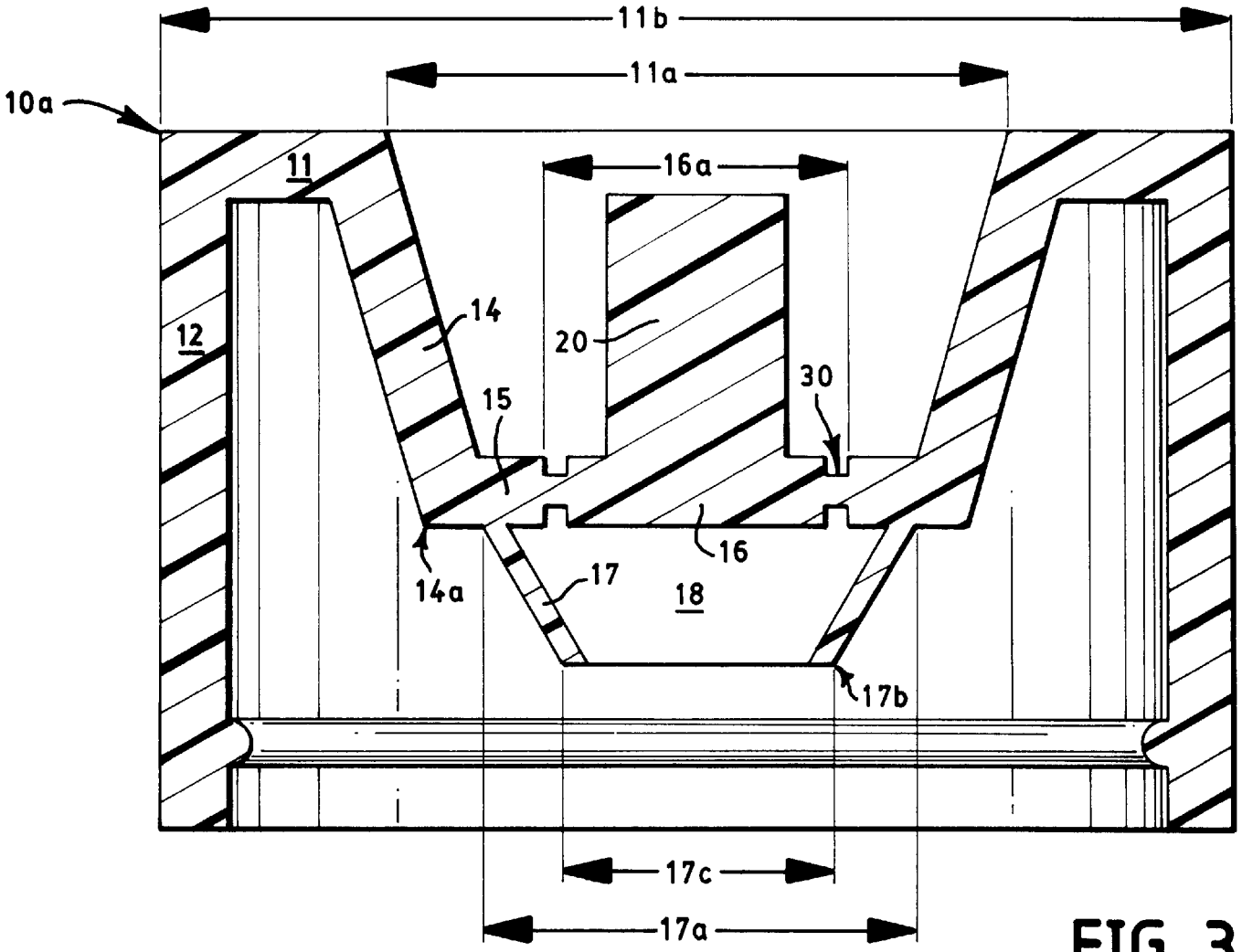
FIG. 3 is a sectional view of the preferred closure taken along the line 3—3 of FIG. 2, showing the cap body.

With reference to FIGS. 1–3, a preferred closure 1 is shown in spaced relation to a container neck 5. The container neck 5 includes an external continuous locking bead 6 on an outer surface 7 thereof.

Figure 5:
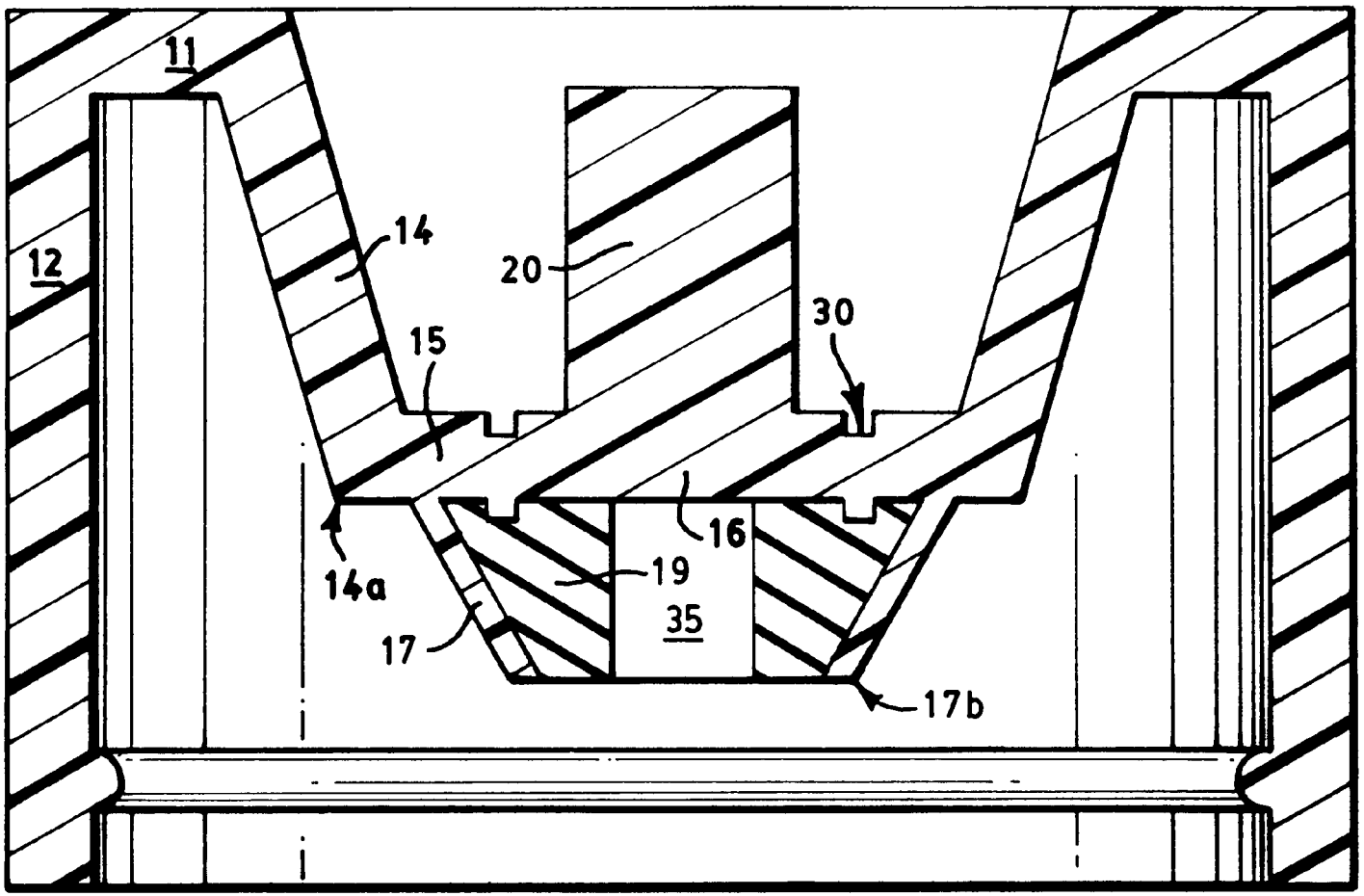
FIG. 5 is a sectional view of the preferred closure taken along line 5—5 of FIG. 4.

According to the preferred embodiment of the present invention, the closure 1 includes a cap body 10 and a gasket valve 19 (FIG. 5). The cap body 10 is made from molded polyethylene, polypropylene or another similar polymer. Further, the cap body 10 includes a top wall 10*a* having an outer perimeter 11*b* and an annular skirt 12 extending downwardly from the outer perimeter 11*b* and terminating in a first end 12*a* thereof. Projecting inwardly from an inner surface 12*b* of the annular skirt 12 near the first end 12*a* thereof is a continuous bead 13 engageable with the external bead 6 of the container neck 5. Further embodiments of the present invention may include conventional alternative means for attaching the closure 1 to the container neck 5, such as by threading, and such alternate attaching means are understood to fall within the scope and spirit of the present invention.

In a preferred embodiment, the top wall 10*a* includes an upper radial ring 11 further having an inner diameter 11*a*, an upper ring surface 11*c* and a lower ring surface.

A downwardly-depending annular shoulder wall 14 extends from the inner diameter 11*a* and terminates in a lower end 14*a* thereof. The shoulder wall 14 includes an inner surface 14*b* and an outer surface 14*c*, wherein the outer surface 14*c* is sized to engage the container neck 5, thereby providing a plug-type, liquid-impervious seal therebetween. A separate ring-shaped sealing liner may be provided on the lower surface of the upper radial ring 11 to further provide an enhanced liquid-impervious seal between the closure 1 and the container neck 5.

A lower shelf 15 lies in a plane coincident with the shoulder wall lower end 14*a* and includes an outer diameter 15*a* coincident therewith. The lower shelf 15 includes an upper surface 15*b*, a lower surface 15*c* and a concentric frangible portion 16. The frangible portion 16 includes an outer diameter 16*a*, an upper surface 16*b* coplanar with the upper surface 15*b* of the lower shelf 15 and a lower surface 16*c* coplanar with the lower surface 15*c* of the lower shelf 15.

At the outer diameter 16*a* of the frangible portion 16, coincident therewith and providing a concentrated stress interface between the frangible portion 16 and the lower shelf 15, are a plurality of arcuate grooves 30 disposed on both the upper surface 15*b* and the lower surface 15*c* of lower shelf 15. The arcuate grooves 30 reduce the thickness of the frangible portion by approximately ½, thereby weakening the lower shelf 15 at the frangible portion outer diameter 16*a*, and providing a means to permit the frangible portion 16 to be removed from the lower shelf 15.

Alternately, the upper radial ring 11, the lower shelf 15 and the frangible portion 16 may be provided coplanar to one another, thereby aggregating a continuous top wall and eliminating the annular shoulder wall 14 altogether. In such an embodiment, a continuous sealing liner may be provided on a lower surface of the top wall to form a liquid-impervious seal between the closure 1 and the container neck 5.

An annular retaining wall 17 extends downwardly and inwardly from the lower surface 15*c* of the lower shelf 15, the retaining wall 17 having an upper diameter 17*a* provided in the plane of the lower surface 15*c* of the lower shelf 15 and terminating at an end 17*b* thereof. The retaining wall terminal end 17*b* includes a lower diameter 17*c*. The retaining wall upper diameter 17*a* is larger than the terminal end 17*b* of the lower diameter 17*c*, thereby providing a downwardly and inwardly slope to the retaining wall 17. Furthermore, the retaining wall upper diameter 17*a* is larger than the frangible portion outer diameter 16*a*, thereby providing the lower shelf 15 with a radial lip 15*d* extending inwardly beyond the retaining wall upper diameter 17*a*.

A pocket 18 is provided in the region defined by an inner annular surface 17*d* of the retaining wall 17, the frangible portion lower surface 16*c*, the radial lip 15*d* and the plane of the retaining wall terminal end 17*b*.

Figure 4:
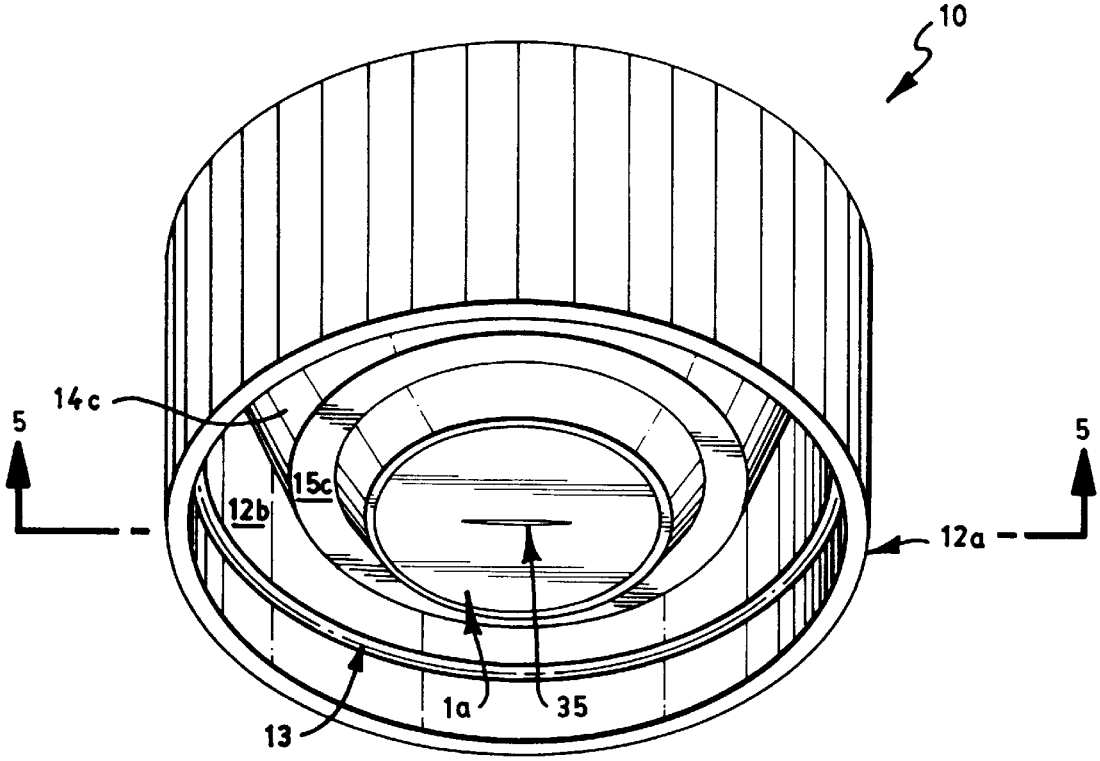
FIG. 4 is a bottom perspective view of a preferred closure, including the gasket valve.

With additional reference to FIGS. 4 and 5, a gasket valve 19 is provided according to the present invention within the pocket 18 and is typically made of silicone rubber or other similar flexible rubber material. The gasket valve 19 conforms to the size, shape and geometry of the pocket 18 and is retained within the pocket 18 by the lip 15*d* and the retaining wall inner annular surface 17*d*. A longitudinal slit 35 is provided through the gasket valve 19.

A tab 20 projects upwardly from the upper surface 16*b* of the frangible portion 16 and includes a lower end 21 formed coincident to and integral with the frangible portion upper surface 16*b*. The tab 20 further includes an upper end 22 opposite the lower end 21 and is provided with a rectangular cross-section which is entirely surrounded by the frangible portion outer diameter 16*a*.

In use, the preferred embodiment of the present invention operates as follows. Engagement of the closure 1 on the container neck 5 provides a liquid-impervious seal therebetween. The continuous bead 13 of the closure 1 engages the mating external continuous bead 6 of the container neck 5, thereby locking and retaining the closure 1 firmly in place over the container neck 5 and preventing dispensing of the contents of the container. The annular shoulder wall 14 projects into the mouth of the container neck 5 and provides a plug-type mating seal therebetween. Furthermore, an optional liner seal disposed on the lower ring surface 11*d* of the upper radial ring 11 may provide an additional seal between the closure 1 and the container neck 5.

Figure 6:
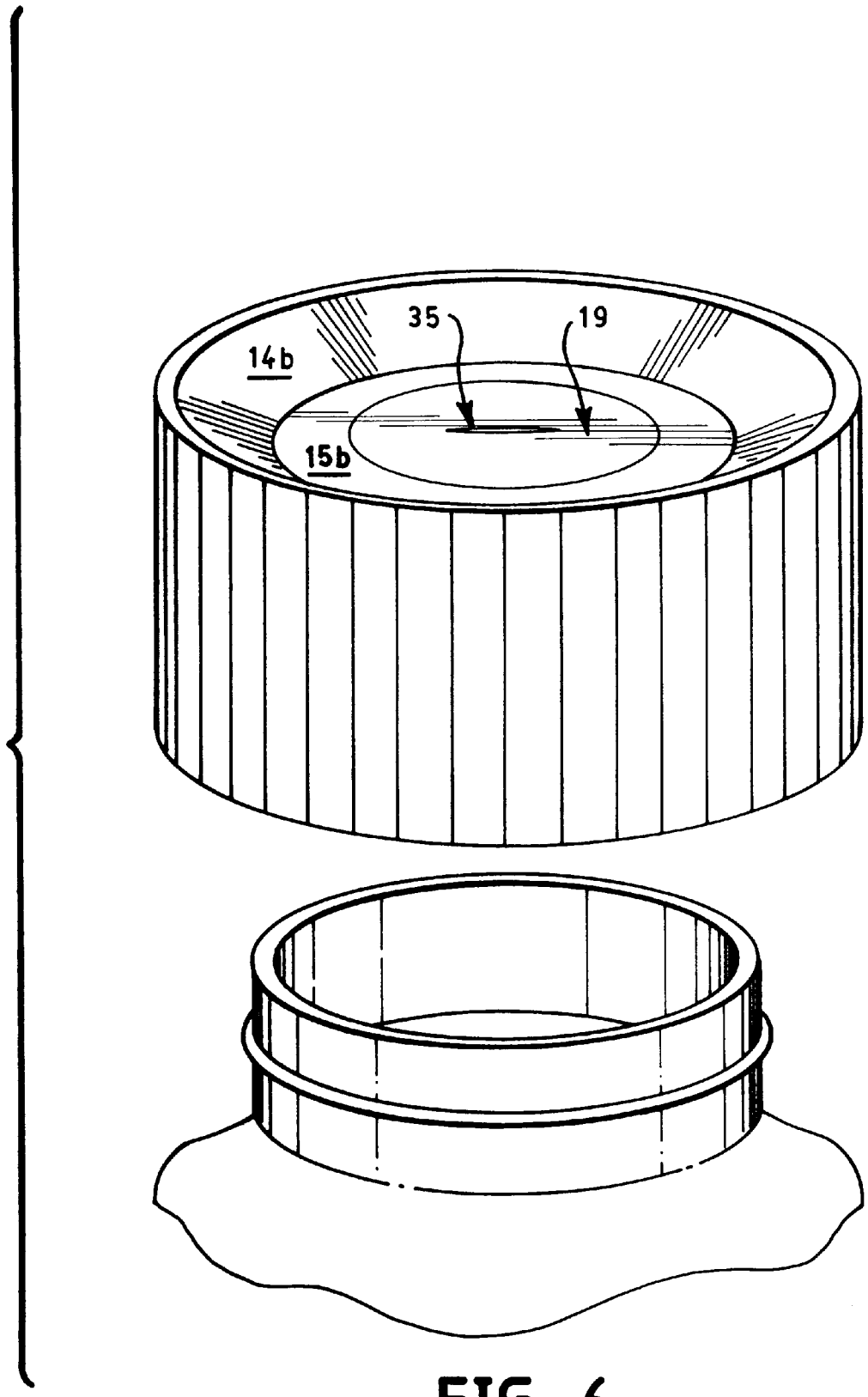
FIG. 6 is a perspective view of the preferred closure and the neck portion of a container, showing the cap body after a frangible portion is removed.

With additional reference to FIG. 6, removal of the frangible portion is described. Prior to removal, the frangible portion 16 is continuous and integral with the lower shelf 15, notwithstanding the arcuate grooves 30. Thus, the sealing integrity of the closure 1 is not compromised by virtue of the frangible portion 16. However, the closure 1 is opened a first time by a user firmly grasping the tab 20 and exerting sufficient removal force to break the bonds between the frangible portion 16 and the lower shelf 15 at the arcuate grooves 30. The tab 20 and the frangible portion 16, both of which form an integral sealing member, is thereafter removed from the closure 1. An upper surface of the gasket valve 19 is now exposed, thereby exposing the slit 35 provided therethrough. The resilient material properties of the gasket valve 19 force the slit 35 to collapse upon itself, thereby sealing the slit 35 and providing a barrier to prevent accidental spillage of the contents of the container.

Dispensing of a liquid from within the container occurs by imposing an inwardly-directed force to the flexible side walls of a typical container (not shown). Such inwardly-directed force creates a greater-than-ambient internal pressure within the container, likewise increasing the pressure behind a lower surface of the gasket valve 19. Such pressure builds up behind the gasket valve 19 until this pressure exceeds the collapsing force imposed on the slit 35 by the inherent resiliency of the gasket valve 19 material. At the point at which such internal pressure exceeds this collapsing force, the slit 35 dilates, thereby permitting liquid from within the container to be dispensed therethrough.

Once the inwardly-directed forces are removed from the container walls, a lower-than-ambient pressure results within the container by virtue of the outwardly-directed resilient force inherent in the material of the container walls, as well as in cooperation with the reduction in the quantity of liquid within the container following dispensing. Ambient air is then sucked back into the container through the slit 35, thereby preventing any further dispensing of the liquid, as well as permitting the slit 35 to return to its original collapsed, sealed position.

Figure 7:
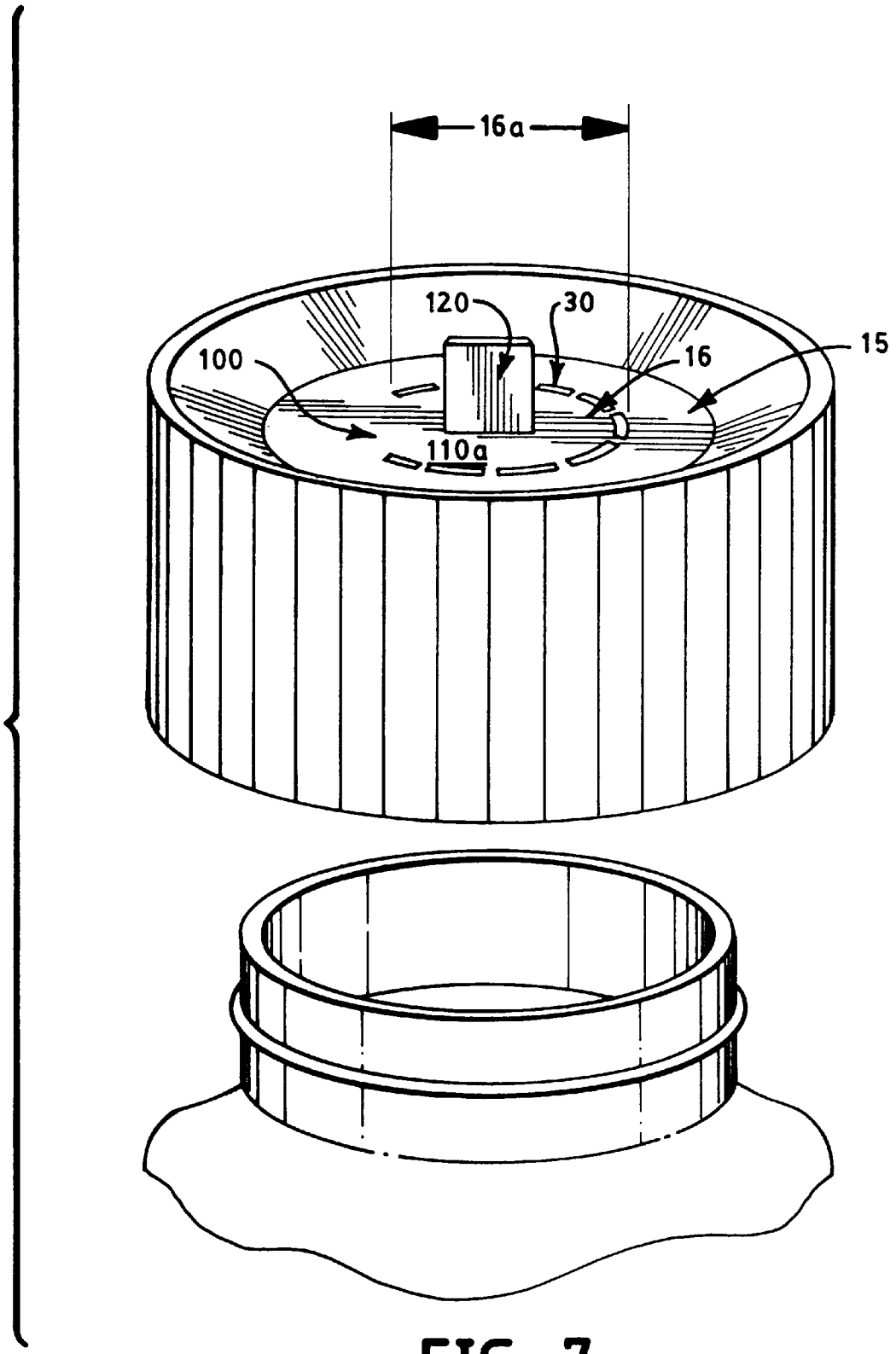
FIG. 7 is a top perspective view of another preferred embodiment of the present invention.

With additional reference to FIG. 7, a first alternative embodiment is shown, wherein the arcuate grooves 30 do not extend around the entire periphery 16*a* of the frangible portion 16. Instead, an integrally-formed hinge 100 is provided in a region of the frangible portion outer diameter 16*a* where the arcuate grooves 30 are discontinuous. Frangible portion 16 thereby provides an attached lid 110 from which an integrally-formed tab 120 may extend upwardly from the upper surface 110*a* thereof. Upon breaking the bonds between the frangible portion 16 and the lower shelf 15 at the arcuate grooves 30 (as by applying sufficient removal force to tab 120), the lid 110 is detached from the lower shelf 15 in the peripheral region corresponding to the arcuate grooves 30, yet remains attached to the lower shelf 15 at the hinge 100. The lid 110 may then be pivoted away from the gasket valve 19 about the hinge 100 to permit dispensing therefrom. Following dispensing, the lid 110 is pivoted back over the gasket valve 19 to reseal same. A locking tab (not shown) may be integrally molded with the lower shelf 15 to provide a means by which the lid 110 may be re-fastened to the lower shelf 15 after the closure 1 has been opened a first time.

In a modification to the present alternate embodiment, a conventional "flip-top" lid may be separately molded and assembled onto the lower shelf.

Figure 8:
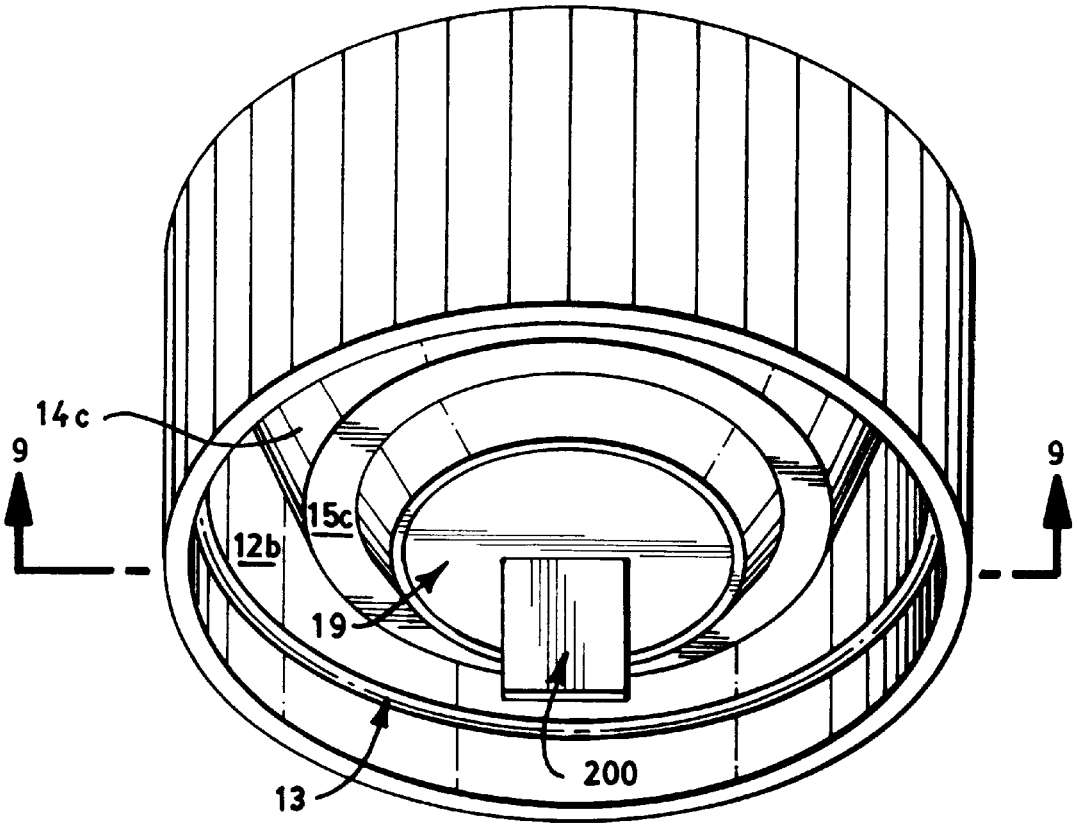
FIG. 8 is a bottom perspective view of an even further preferred embodiment of the present invention, showing a closure before a frangible portion is removed; and, FIG. 9 is a sectional view of the embodiment of FIG. 8 taken along the line 9—9 of FIG. 8, showing the closure after the frangible portion is removed.
Figure 9:
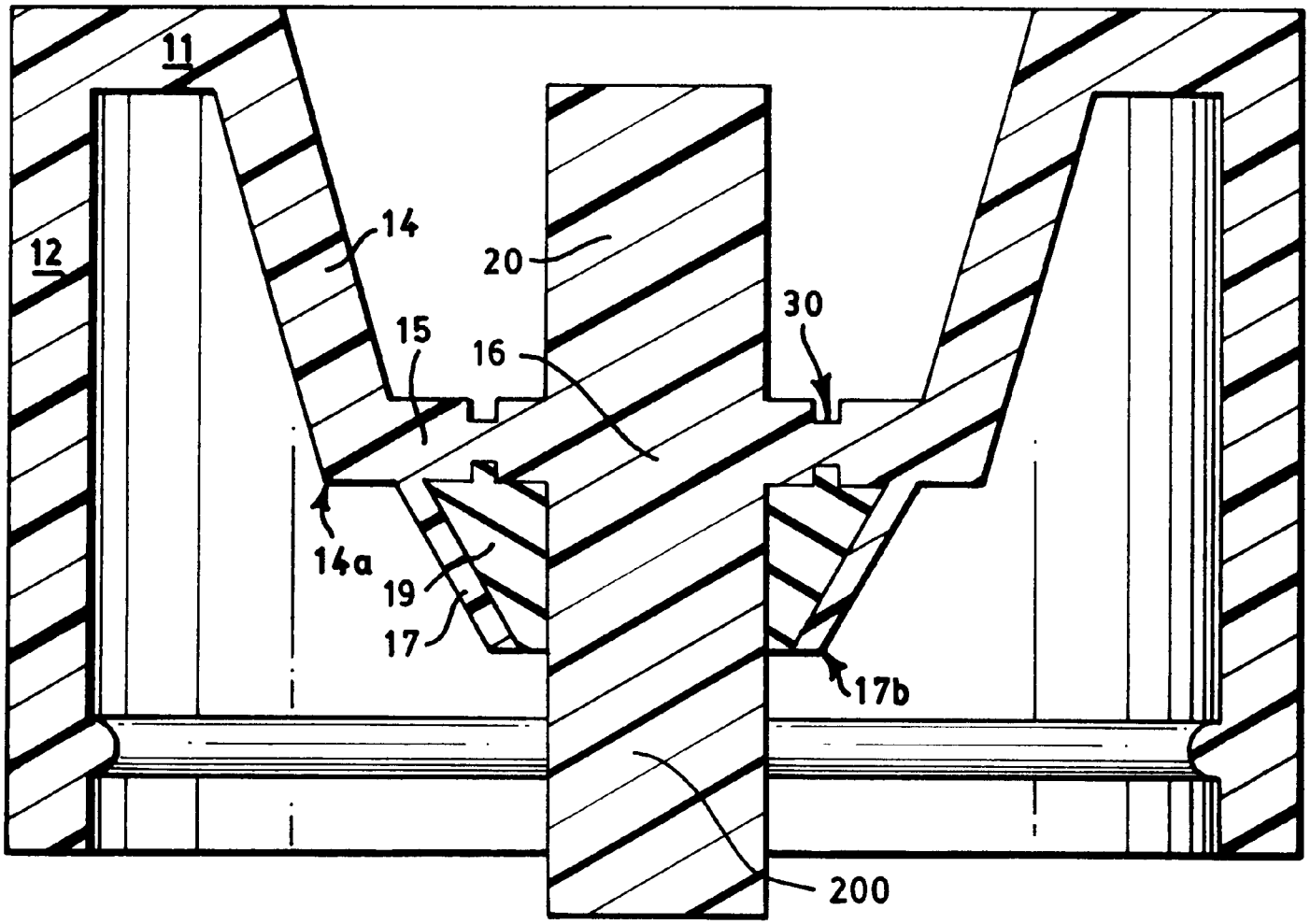

With additional reference to FIGS. 8 and 9, a second alternative embodiment is shown, wherein a removable knife member 200 is integrally formed with the frangible portion 16 and extends downwardly therefrom. The knife member 200 includes an upper end 210 coincident to and integral with the frangible portion lower surface 16c and a lower end 220 projecting through the pocket 18 and into the mouth of the container neck 5. In this embodiment, the tab 20, the frangible portion 16 and the knife member 200 form an integral sealing member, which may be removed a first time from the cap body according to the preferred embodiment of the present invention. Formation of a slit 35 in the gasket valve 19 according to the present embodiment occurs by depositing a specific quantity of liquid gasket valve material into the pocket 18 around the protruding knife member 200 and thereafter allowing the gasket valve 19 to cure in place. Upon removal of the frangible portion 16, the knife member 200 is likewise removed from within the gasket valve 19, thereby creating the slit 35 in the location where the knife member 200 was theretofore present.

The present invention furthermore includes a method for making a closure as herein described. According to the present invention, a mold is provided conforming to the size, shape and geometry of a cap body 10. It is a preferred feature of the present invention that the cap body 10 include a pocket 18 for receiving a gasket valve 19. Polyethylene, polypropylene or other similar polymer may be injected into the mold, thereby forming an integral hard plastic shell of the cap body 10. The cap body 10 is thereafter removed from the mold and inverted. A small quantity of liquid gasket valve material is deposited into the pocket 18, wherein the gasket valve 19 is permitted to cure using heat generated by a microwave or other conventional heat source. A longitudinal slit 35 is then punched in and through the gasket valve 19 by modified punching equipment having a hardened metal or plastic punching blade. The punching step must be accomplished by forcing the punching blade through the gasket valve 19, and embedding the punching blade marginally into the frangible portion 16. However, the punching blade must not pierce the frangible portion.

In the second alternative embodiment hereinabove disclosed wherein a knife member 200 is provided integrally with and protruding from the frangible region 16, the closure 1 is complete upon the curing of the gasket valve.

The foregoing detailed description is given primarily for clearness and understanding and no unnecessary limitations are to be understood therefrom for modifications will become obvious to those skilled in the art upon reading this disclosure and may be made without departing from the spirit of the present invention.

We claim:

1. A closure comprising:

a cap body having a top wall with an outer perimeter and an inner perimeter, an annular skirt depending downwardly from said outer perimeter, an annular shoulder wall depending downwardly from said inner perimeter and a lower shelf coplanar with a lower end of said shoulder wall;

said annular skirt having a first end opposite said top wall;

a frangible portion spaced inwardly from said first end;

a gasket valve integrally and concentrically formed on a lower surface of said top wall with an outer periphery surrounding said frangible portion; and, a removable sealing member integrally formed on an upper surface of said frangible member.

2. A closure according to claim 1, wherein:

said cap body further comprises an annular retaining wall integrally and coaxially formed with said lower shelf, said retaining wall extending downwardly and inwardly from said lower surface of said lower shelf.

3. A closure according to claim 1, wherein:

said gasket valve is constructed from a molded liquid silicone rubber.

4. A closure according to claim 1, wherein:

said cap further comprises a continuous annular bead integrally formed with an interior annular surface of said annular skirt towards said first end thereof.

5. A closure according to claim 4, wherein:

said cap body further comprises an annular retaining wall integrally and coaxially formed with said top wall, said retaining wall extending downwardly and inwardly from said lower surface of said top wall.

6. A closure according to claim 5, wherein said removable sealing member further comprises:

a tab extending upwardly from said upper surface of said frangible portion, said tab having an upper end and a lower end, said lower end formed coincident to and integral with said upper surface of said frangible portion.

7. A closure according to claim 6, wherein:

said removable sealing member further comprises a knife member extending downwardly from said lower surface of said frangible portion, said knife member having an upper end and a lower end, said upper end formed coincident to and integral with said upper surface of said frangible portion, said lower end projecting longitudinally through said gasket valve.

8. A closure according to claim 1, wherein:

said cap body further comprises an continuous annular bead integrally formed on an interior annular surface of said annular skirt toward said first end thereof.

9. A closure according to claim 8, wherein:

said cap body further comprises an annular retaining wall integrally and coaxially formed with said lower shelf, said retaining wall extending downwardly and inwardly from said lower surface of said lower shelf.

10. A closure according to claim 9, wherein said removable sealing member further comprises a tab extending upwardly from said upper surface of said frangible portion, said tab having an upper end and a lower end, said lower end formed coincident to and integral with said upper surface of said frangible portion.

11. A closure according to claim 10, wherein said removable sealing member further comprises:

a knife member extending downwardly from said lower surface of said frangible portion, said knife member having an upper end and a lower end, said upper end formed coincident to and integral with said upper surface of said frangible portion, said lower end projecting longitudinally through said gasket valve.

* * * * *